US005910656A

United States Patent [19]

Köster et al.

[11] Patent Number: 5,910,656

[45] Date of Patent: Jun. 8, 1999

[54] ADJUSTMENT OF THE SAMPLE SUPPORT IN TIME-OF-FLIGHT MASS SPECTROMETERS

[75] Inventors: Claus Köster, Lilienthal; Armin Holle, Oyten; Jochen Franzen, Bremen, all of Germany

[73] Assignee: Bruker Daltonik GmbH, Bremen, Germany

[21] Appl. No.: 08/911,150

[22] Filed: Aug. 14, 1997

[30] Foreign Application Priority Data

Aug. 20, 1996 [DE] Germany ..... 196 33 441

[51] Int. Cl.[6] ..... H01J 49/04

[52] U.S. Cl. ..... 250/287; 250/252.1

[58] Field of Search ..... 250/287, 288, 250/288 A, 473 R, 252.1

[56] References Cited

U.S. PATENT DOCUMENTS

| | | | |
|---|---|---|---|
| 4,243,887 | 1/1981 | Hillenkamp et al. | 250/423 R |
| 4,740,692 | 4/1988 | Yamamoto et al. | 250/288 |
| 5,498,545 | 3/1996 | Vestal | 250/288 |

FOREIGN PATENT DOCUMENTS 2202368 9/1988 United Kingdom .

OTHER PUBLICATIONS

Robert S. Brown et al, *Mass Resolution Improvement by Incorporation of Pulsed Ion Extraction in a Matrix–Assisted Laser Desorption/Ionization Linear Time–of–Flight Mass Spectrometer,* Analytical Chemistry, vol. 67, No. 13, pp. 1998–2003, Jul. 1, 1995.

Johann M. Grunderwurmer et al., *High–resolution mass spectrometry in a linear time–of–flight mass spectrometer,* International Journal of Mass Spectrometry and Ion Processes, vol. 131, pp. 139–148, 1994.

*Primary Examiner*—Kiet T. Nguyen

[57] ABSTRACT

A time-of-flight mass spectrometers, in which the ions are generated by ionization of analyte substances on a sample support, by matrix-assisted laser desorption (MALDI). The time-of-flight mass spectrometer consists of using space-adjusting actuators to set the spacing of the sample support from the nearest acceleration electrode so that the flight time of ions of a reference substance prescribed by the calibration can be precisely adjusted. Due to this adjustment of the spacing, a once only calibration of the relationship between the flight time and mass (i.e. the mass scale) may be constantly retained.

18 Claims, 1 Drawing Sheet

ADJUSTMENT OF THE SAMPLE SUPPORT IN TIME-OF-FLIGHT MASS SPECTROMETERS

FIELD OF INVENTION

The invention relates to the precise mass determination of analyte ions in high resolution time-of-flight mass spectrometers, in which the ions are generated by ionization of analyte substances on a sample support, for example by matrix-assisted laser desorption (MALDI). It particularly relates to methods and devices for keeping valid a once calibrated mass scale by means of internal reference substances.

PRIOR ART

There are several different methods by which solid substances—placed on the surface of a sample support—may be ionized. Among these are ion bombardment (secondary ion mass spectrometry=SIMS), laser desorption (LD), shock waves, and so-called plasma desorption (PD), which is triggered by high-energy fission particles. A further method, matrix-assisted laser desorption (MALDI) has found the widest acceptance for the ionization of large molecules. If such a method is coupled with a time-of-flight mass spectrometer, it is necessary to generate the ions in an extremely short time to form a sharp ion pulse, e.g., by a laser pulse. In all these methods, the ions generally have a rather substantial start velocity with a large spread around an average velocity once they have left the surface. The average velocity leads to a non-linear relationship between the ion flight time and root of the ion mass. The velocity spread leads to poor mass resolution with broad ion signals from individual ion masses, however there are methods to improve resolution. In the following, particular attention is paid to the MALDI method, however the conclusions should not be limited just to this method.

For the ionization of large sample molecules by matrix-assisted laser desorption (MALDI), the large sample molecules are stored—separated from each other—in or on a layer of a low-molecular matrix substance on a sample support. A light pulse of a few nanoseconds duration, from a laser focused onto the sample surface, vaporizes a small amount of matrix substance in a quasi-explosive process, and the separated sample molecules are also transferred into the initially tiny vapor cloud.

The vapor cloud expanding into the vacuum not only accelerates the molecules and ions of the matrix substance through its adiabatic expansion, but also accelerates the molecules and ions of the sample substance through viscous entrainment, which thereby receive higher kinetic energies than would correspond to the thermal equilibrium. Even without an accelerating field, the ions attain average velocities of about 500 to 1,000 meters per second, depending upon the energy density of the laser beam; the velocities are to a large extent independent of the mass of the ions, however they have a large velocity spread which ranges from about 200 up to 2,000 meters per second. It can be assumed that the neutral molecules in the cloud also have these velocities.

The ions are accelerated in the ion source with electrical fields to energies of around 10 to 30 keV, injected into the flight path of the mass spectrometer, and detected by a time-resolving detector at the end of the flight path. Their mass-to-charge ratio can be determined from their flight time. Since this type of ionization produces predominantly only singly charged ions, the following discussion will mostly deal with mass determination, but it should be kept in mind that the determination more precisely concerns the mass-to-charge ratio.

Flight times are converted into masses via a calibration curve, the acquisition of this calibration curve being described as the "calibration of the mass scale" of the time-of-flight spectrometer. The calibration curve can be stored as a sequence of flight-time value and mass value pairs in the memory of the data processing system, or stored in the form of parameter values for a function given as a mathematical formula.

During the formation of the hot vapor cloud, a very small portion ($10^{-6}$ to $10^{-4}$) of the molecules, both matrix and sample molecules, are ionized. During the expansion of the vapor cloud, continuous ionization of the large molecules takes place through ion-molecule reactions at the cost of smaller matrix ions.

The large spread of velocities and the time-smeared formation process of the ions limit the mass resolution of both linear spectrometers as well as of energy focusing, reflecting time-of-flight mass spectrometers. A spread of initial velocities alone could be focused out with the energy focusing reflector, but not the ions which result from time smearing.

There is a well-known method for increasing the mass resolving power under these conditions. The ions in the cloud are first allowed to fly for a brief period of time in a field-free region without any electrical acceleration. The faster ions thereby distance themselves further from the sample support electrode than the slow ions, and a spatial distribution results from the distribution of ion velocities. Only then the acceleration of the ions in a homogenous acceleration field is switched on. The homogenous acceleration field is characterized by a potential linearly decreasing with distance. At the start of acceleration, the faster ions are more distant from the sample support electrode, and therefore encounter a somewhat reduced acceleration start potential, which provides them with a somewhat lower final velocity for the drift region of the time-of-flight mass spectrometer than the initially slower ions. With the correct selection of time lag and acceleration field strength, the initially slower, but after acceleration faster ions could catch up with the initially faster, but after acceleration slower ions precisely at the detector. In this way ions are dispersed at the location of the detector relative to the mass, but, if of equal mass, are focused in first order relative to the flight time (more exactly: only ions of one mass are focused correctly, but neighboring masses show also sufficiently good resolution). Thus a higher mass resolution is achieved in a linear time-of-flight mass spectrometer (at least for one selectable mass). There is a similar method for time-of-flight spectrometers with reflectors.

Switching on of the acceleration field must not switch the entire acceleration voltage. Switching of such high voltages in extremely short times of a few nanoseconds is almost unachieveable even today and is associated with high costs. Switching of a partial voltage is sufficient, if an intermediate electrode is installed in the acceleration path. Then only the space between the sample support electrode and intermediate electrode must initially be without a field and then switched over to an acceleration field after a time lag. The spacing between the sample support and the intermediate electrode should be as small as possible, in order to switch the smallest possible voltages. There is, however, a lower limit (of about one millimeter) for this spacing, which is hardly realizable for designs of ion sources. Distances of about 2 to 4 millimeters are usually applied.

The desire for good mass resolution is primarily directed toward achieving good mass determination. However, since the introduction of this method, it has become apparent that though in principle the method can produce good mass determination, it does not always lead to correct mass determination. The function which describes the mass in dependence on the flight time (in short: the mass scale) is frequently not constant during subsequent analysis runs for MALDI ions. For an ion with a mass of 5,000 atomic mass units, the result of the mass calculation may fluctuate in extreme cases by several mass units from one analysis run to the next.

It has therefore become customary for the purpose of precise mass determinations to correct the masses of the analyte ions by simultaneous measuring the flight time of ions from added known substances (so-called "internal reference substances"). As the simplest method, the mass of the analyte substances was corrected here by assuming a linear relationship between the time of flight and the root of the mass. The known ions of the matrix, especially its dimeric ion, were frequently used as reference masses. This method leads to substantially improved accuracy for the mass determination, in the order of about 200 ppm. However this still leaves an uncertainty of one mass unit for the ion of mass 5000 u.

According to DIN, the term "precise" is used for high repeating accuracy, and the term "accurate" for correct determination of mass with an as small as possible deviation between the corrected measurement value and the true value of the mass.

Theoretical analysis of the problem

With zero initial velocity of the ions, the relationship between the flight time of the ions and the root of their mass is strictly linear. However, with an average initial velocity of the ions, this relationship is no longer linear; it has a weak quadratic term which cannot be neglected if a high accuracy of the mass measurement is required. This quadratic term does not vanish if the resolution is improved by delayed acceleration (often described as "delayed extraction").

If we introduce the abbreviation $$w = \sqrt{\frac{m}{q}}. \tag{1}$$

for the root of the mass-to-charge ratio, the relationship between the flight time t (measured from the start time of the delayed acceleration) and the root w takes on the following form:

$$t = \left(\frac{l}{\sqrt{2 \times U}} + \frac{d}{\sqrt{\Delta U / 2}}\right) \times w - \frac{v \times d}{\Delta U} \times w^2, \tag{2}$$

where U is the full acceleration voltage, I is a reduced flight path which is only dependent upon the geometry of the time-of-flight spectrometer, and ΔU is the voltage between the sample support and the nearest acceleration electrode (if applicable, the intermediate diaphragm for delayed switching on of the acceleration). The parameter d is the distance between the sample support and the intermediate diaphragm, and v is the average start velocity of the ions. The term with $w^2$ is small compared to the linear term in w, however it attains significant influence with increasing mass.

Through mathematical derivation of this theoretically obtained relationship according to various instrumental or process engineering parameters, we were able to check the criticality of these parameters. We thereby determined that one parameter has an enormous influence: the distance d of the sample support from the first acceleration diaphragm (the intermediate electrode in the case of delayed acceleration). This parameter cannot be kept completely constant because various sample supports have to be loaded with samples and have to be mounted—through lock systems—on movable sample support holders of the ion source. Of less influence is the average velocity v of the ions when acceleration starts. All remaining parameters are voltages or geometric dimensions which can be kept very precisely constant Displacements of the mass scale relative to calibration are even partly due to the sample substance layers being of varying thicknesses. Today, the samples are usually applied in solution to the sample supports, together with dissolved matrix substance. The goal is to generate small crystals for the matrix which enclose the sample molecules. Growth of these crystals during the drying process cannot however be controlled; sometimes large crystals are produced, at other times small ones. This method, however, is currently being replaced by methods which produce layers of uniform thickness.

Modern sample supports should hold thousands of samples, therefore they are designed with a large area, aiming for sample supports in excess of 100 millimeters in linear dimensions. The sample supports are introduced via locks into the vacuum system of the mass spectrometer where they are inserted into a holder which is moved by a movement device. Insertion into the slide rails of the holder with spring action positioning does not occur as precisely as necessary due to the vacuum conditions. Parallel displacement of this sample support for the scanning of different samples can easily cause a change in the distance d to the intermediate electrode on the order of magnitude of several tenths of a millimeter. With a change of this distance d by only 100 micrometers, the flight time of the ions is already changed to such degree that the signal of an ion of the mass of 5,000 u appears displaced by more than one full mass unit on the mass scale.

Up to now it has not been possible to find an electrical compensation for a varying distance d to reconstruct the once calibrated relationship between flight time and mass (i.e. the mass scale) through purely electrical adjustment for all masses. From the equation (2), such an electrical compensation cannot be seen since a change in the distance d in the linear term must be compensated via the root of ΔU, where according to the quadratic term it must be compensated linearly with ΔU.

By improvement of the MALDI method, one can now quite successfully keep constant the average start velocity v of the ions, which occurs in the quadratic term. One can particularly reduce the dependency of start velocity v on the radiation density by the laser by using explosive matrix components.

In the case of delayed acceleration, it is particularly true that a change of ΔU does not restore the flight times of the ions if it is done in such a way that a best mass resolution results. The restoration of the best resolution must return the acceleration field, i.e. the relation dlΔU, to its predetermined value.

It has been customary for some time to make a proportional correction of the mass of the analyte ions via simultaneous scanning of the spectrum of an internally added reference substance. But since the parameter d occurs both in the linear and in the quadratic term, this proportional correction with the root of the mass leads only to partial success. This can only be done if a reference mass is selected which is close to the analyte mass.

OBJECTIVE OF THE INVENTION

It is the objective of the invention to find a method by which very accurate mass determinations can be carried out in time-of-flight mass spectrometers with an ionization of superficially applied samples. It is the particular objective of the invention to correct the displacements of the ion masses, which have been occuring in varying degrees, on the mass scale in such a way that the calibration curve can be retained for the entire mass scale and that the mass of the ions can be accurately determined far beyond the range of 5,000 u at least to within one mass unit.

BRIEF SUMMARY OF THE INVENTION

It is the basic idea of the invention to mechanically correct the distance d between the sample support and the intermediate electrode during measurement, so that the flight time of the ions and therefore the validity of a once performed calibration of the mass scale is restored. The distance d of the sample support from the intermediate electrode must be adjusted, preferably using electromechanical actuators, in such a way that the flight time of the ions of a reference substance takes on the value predetermined by the calibration.

If by adjusting the distance d, the flight time t of a given reference ion is correctly adjusted, then the dependence of all the other masses on the flight time is correct according to the equation (2). The calculated mass scale is then once again valid. In this way a reproducibility of the mass determination is achieved which is much better than the previously used proportional consideration of the reference mass.

Piezoelements, bimetal elements and even motorized actuators can be used as actuators for the control of the distance of the sample support from the acceleration diaphragm. The adjustment can then be made fully automatic, e.g. by appropriate software control.

For large movable sample supports, at least three actuators are necessary which should be located as closely as possible to the edge of the retaining frame of the sample support The reference samples are placed most appropriately on the points of the sample support under which the actuators are located. In this way adjustment of the correct distance for each position is made easier. Once the large sample support plate has been adjusted in three positions (3-point adjustment), the samples of all remaining items can be measured automatically. If the movement of the sample support plate takes place strictly parallel to its surface, the actuators need no longer to be moved after the initial adjustment.

Figure 1:
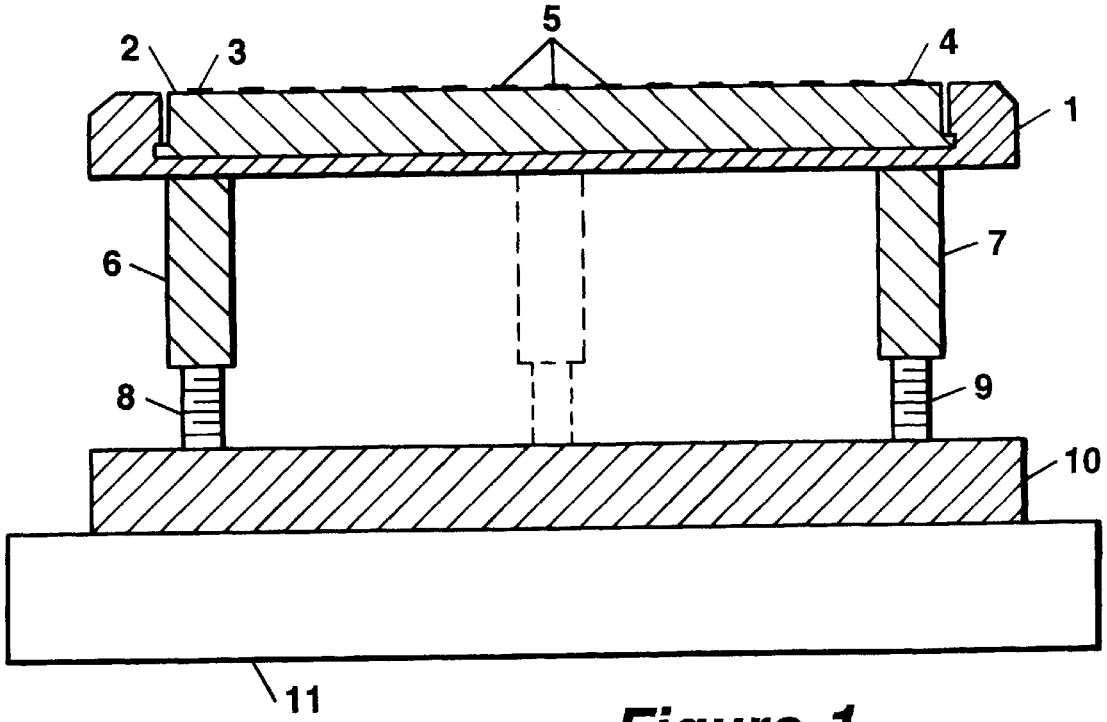
FIG. 1 shows the design of a holder for the sample support as it is mounted in the vacuum system of the mass spectrometer as part of the ion source. The entire holder is shiftable via a movement device parallel to the surface of the sample support. It consists of the following parts.

1=Holding plate for the sample support with slide rails,
2=Sample support with samples 3, 4, 5 on its surface,
3=Reference sample over actuator 8,
4=Reference sample over actuator 9,
5=Samples of the analyte material,
6=Isolator over actuator 8,
7=Isolator over actuator 9,
8, 9=Actuators for changing the distance between the holding plate and base plate (for example as a bundle of piezoelements). The third actuator is not on the plane of the drawing and is only suggested by a dotted line.
10=Base plate of the holder,
11=Movement device for shifting the holder parallel to the surface of the sample support (i.e. along two coordinates).

Figure 2:
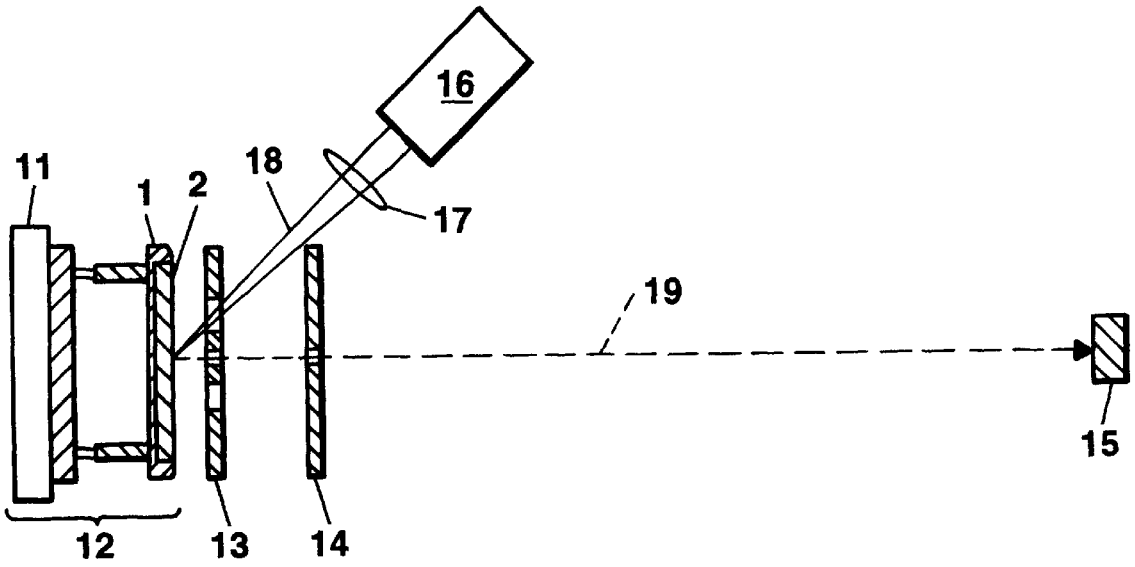

FIG. 2 shows the basic scheme of the time-of-flight mass spectrometer. The ion source consists of a laser 16, sample support 2 (inserted in the holder 12) and acceleration electrodes 13 and 14. Ions accelerated in the acceleration path between sample support 2, intermediate diaphragm 13 and base diaphragm 14 traverse the flight path between base electrode 14 and detector 15 as an ion beam 19 and are measured by time resolution at detector 15. The distance between sample support 2 and intermediate electrode 13 is variable using actuators 8 and 9 (see FIG. 1).

12=Holder for the sample support 2 (reproduced in FIG. 1 in detail)
13=Intermediate electrode of the ion source
14=Base electrode (completes the ion source with its ion acceleration device)
15=Ion detector
16=Pulsed laser
17=Lens
18=Focused light beam
19=Ion beam, traverses the flight path between base diaphragm 14 and detector 15.

PARTICULARLY FAVORABLE EMBODIMENTS

The method presented here for precise mass determination according to this invention is based upon the device shown in FIGS. 1 and 2. An embodiment is presented with a large sample support and three actuators. Any specialist is capable of translating the basic principle to other sample supports, for example with fewer actuators.

The embodiment of the holder for large sample supports with three actuators is schematically shown in FIG. 1. Only actuators 8 and 9 are illustrated in the drawing, the third actuator is not on the plane of the drawing and is only suggested by a dotted line.

The sample substances 5 and the reference substances 3, 4 are applied together with the matrix substances on the surface of the metallic (or metallized) sample support 2. Sample support 2 is introduced through a vacuum lock (not shown) into the vacuum of the mass spectrometer and inserted there automatically into the slide grooves on the holding plate 1. Sample support 2 is held in the slide grooves by springs in one position which does not change even during slight vibrations of the spectrometer. Holding plate 1 is subjected to the accelerating high voltage and is therefore connected to actuators 8 and 9 via isolators 6 and 7. The actuators 8 and 9 are situated on base plate 10 of the holder, allowing a limited change of the distance between the base plate 10 and sample support 2. The maximum changes of the distance need only be about 200 micrometers if the mounting and holder tolerances can be limited to about 150 micrometers. Sample support 2 can be adjusted together with the holding plate, isolators and actuators parallel to its sample surface in two directions through movement device 11, and in this way, very many samples can be applied next to one another and be analyzed one after the other.

As actuators, piezoelements may preferably be used. Bending disc elements operating piezoelectrically are commercially available which, at 50 millimeters diameter and 12 millimeters height, offer a height adjustment path of 200 micrometers. A greater adjustment path can be achieved by stacking the actuators.

The sample support holder 12 with its movement device 11 is a part of the ion source of the time-of-flight mass spectrometer as shown in FIG. 2. The sample support 2 serves here as the first acceleration electrode for the ions, therefore it is supplied with the required voltage which is generally 10 to 30 kilovolts. The intermediate electrode 13 is at a lower potential in the acceleration phase so that a first acceleration field for the ions is created between the sample support 2 and the intermediate electrode 13. Between the intermediate diaphragm 13 and the base electrode 14, which is at the potential of the flight path, there is a second acceleration field.

When using acceleration with delayed initiation as described above, the intermediate electrode is initially at the potential of the sample support and is switched down after a time lag of several tens to hundreds of nanoseconds.

With this arrangement for a time-of-flight mass spectrometer, spectra of analyte substances can be scanned as usual. Scanning begins with ionization of the sample substances on the sample support, according to the MALDI method of ionization is described here. The ions are generated by a light flash of about 3 to 5 nanoseconds in length from laser 16. Usually, UV light with a wavelength of 337 nanometers is used from a moderately priced nitrogen laser. The light flash is focused through lens 17 onto the surface of the sample support. After their acceleration in the electrical fields between electrodes 2, 13 and 14, the ions pass through the flight path of the mass spectrometer and are measured at the end of the flight path by ion detector 15.

The time variable ion current, provided by the ion beam at the end of the drift tube, is usually measured and digitalized at the detector 15 with a scanning rate of 1 or 2 gigahertz. Normally, the simultaneous measurement values from several scans are added before the mass lines in the stored data are sought and transformed using the data evaluation from the time scale into mass values via the mass calibration curve.

The flight time must be kept constant with a precision of much less than one nanosecond. The flight time is normally calculated as the center of gravity of the flight time line profile. The line profile is scanned according to current technology using a transient recorder with 1 or 2 gigahertz. Generally, the measurements from several measurement cycles are added up before the gravity center is calculated.

According to the method of this invention, scanning has been improved in order to arrive at more easily reproducible flight times for the ions, and to find a more correct determination of mass via calibrated correlation between flight time and mass using measurement of the flight time.

The method consists of first verifying the distance d before scanning so as to ensure precise and accurate measurement of the masses. This is done by measuring the flight times of a reference mass, and if necessary, readjusting distance d using the actuators introduced here. For this purpose, the flight time of reference ions is measured in a first sample measurement and compared to the target flight time. If there is a deviation, distance d is corrected using the actuators. The correction can be calculated from the known behavior of the actuators and the deviation of the flight time. For very accurate measurements, a repetition of the reference measurement with a second correction is appropriate.

The adjustment can be made fully automatic, e.g. by appropriate software control. Controller 20 in FIG. 2 receives the output of the detector 15 and calculates the flight time of the reference ions in a known manner. By comparing this calculation to a predetermined calculated flight time, the software control is then able to provide appropriate feedback control signals to the actuators connected to the sample support.

If the mass of the reference ions is much smaller than that of the analyte ions, as for example when the always present matrix ions are used as reference ions, a special method for improvement of the mass accuracy can be applied: one can reduce all the acceleration voltages of the time-of-flight spectrometers proportionally, for example from 30 kilovolts to 2 kilovolts, and then proceed with the adjustment of the distance d using the flight time of the matrix ions. The flight time of the matrix ions must then be adjusted to a value which corresponds to the calibration curve for the mass scale at this lowered voltage. After returning to the high voltage, the analyte ions can be measured correctly since the distance d is now correct. It is not even necessary to have calibrated the entire mass scale for the lowered voltage; it is sufficient to know the value of the flight time for the matrix ions. This can be easily measured at the same time as calibrating the mass scale. The voltages can be measured and set so precisely nowadays that voltage inaccuracies are unimportant For sample supports with a small sample surface area, generally only one single actuator is required since the parallelism is in general guaranteed sufficiently well by the mounting. For MALDI sample substances of varying thicknesses, the distance must be controlled for every measurement of a sample. It is then necessary to measure the ions from a reference sample during the measurement of the analyte ions. In many cases ions from the matrix may be used for this, for example the frequently occurring dimeric or trimeric ions of the matrix substance. Here the special method described above with a reduction of the acceleration voltages may be used. In other cases, a suitable reference substance must be added to the analyte substance.

The goal of automatic measurement of thousands of samples makes larger sample supports necessary. These can certainly be created so flat that the effect of deviations in flatness for the distance of the sample support may be disregarded The samples may also be applied very uniformly thin, so that hardly any deviations result But precise positioning of the distance within the vacuum system is difficult since neither lubricating greases nor very narrow sliding tolerances can be used. When introducing the sample support into the holder and during parallel movement of the sample support, changes in the distance from the intermediate electrode occur very easily and these must be readjusted according to this invention.

For such large sample supports, at least three actuators are necessary which should be located as closely as possible to the edge of the retaining frame of the sample support. The reference samples are placed most appropriately on the points of the sample support under which the actuators are located. In this way adjustment of the correct distance for each position is made easier. Once the large sample support plate has been adjusted in three positions (3-point adjustment), the samples of all remaining items can be measured automatically. The actuators are no longer moved after the initial adjustment.

Maintaining the correct distance only produces parallelism to the acceleration diaphragm if the device is correctly adjusted for parallel displacement of the sample support the parallelism of the sample support is responsible for the direction of the ion beam. Since the ion detector is only completely illuminated by the ion beam when parallelism is good, the number of measured ions and therefore the sensitivity of the time-of-flight spectrometer is dependent upon this parallelism.

The actuators can also be used for the adjustment of the parallelism of the sample support in case the parallel displacement device is not adjusted completely perpendicular to the beam direction. To do this it is necessary not only to balance the spacing of the test points but also to adjust their parallelism, and correspondingly correct the three actuators also according to the parallel displacement of the sample support. This uniform change of the three actuators during parallel displacement can be calibrated one single time after installation of the movement device and then be used over and over again.

If the sample substance is unevenly thick, or if a wavy matrix film is stuck onto the sample support, distance control is necessary for each individual sample. For this, a simultaneous reference measurement is again always necessary.

It is a particular advantage of this invention that the optimum mass resolution through delayed initiation of the acceleration is always achieved automatically by mechanical adjustment of the distance. Neither an electrical compensation of variable distance d, which can only be done for a small mass range anyway, nor a purely calculated correction of the mass scale during a supplementary data evaluation can make or reproduce this optimum mass resolution.

It is a further particular advantage of the invention that correction of the distance d also restores the second order focusing in a time-of-flight mass spectrometer with reflector. Readjusting the distance eliminates the cause for all deviations and does not merely treat the symptom. The polarity of the high voltage used for ion acceleration must be equal to the polarity of the ions being analyzed: positive ions are repulsed by a positively charged sample support and accelerated, negative ions by a negatively charged sample support.

Of course, the time-of-flight mass spectrometer can also be operated in such a way that the flight path is in a tube which is at the acceleration potential, while the sample support is at base potential. In this particular case, the flight tube is at a positive potential when negatively charged ions are to be analyzed, and vice versa. This operation simplifies the design of the ion source, since isolators 6 and 7 are no longer necessary. However, there are disadvantages in other areas.

It is convenient when adjusting the distance d, to use the ions of the matrix since no special reference substance then needs to be added. It has become apparent that monomer ions are not well suited due to their much too high intensity and the resulting overloading of the measurement device, and furthermore their mass is so far down on the bottom margin of the usable mass range, that extrapolation into the desired mass range is unfavorable. In most spectra however, there are dimeric ions in the correct intensity range, sometimes even trimeric or even higher oligomeric ions. These lines are very sharp and are more suitable due to their higher mass. The masses of these ions are still very small however compared to heavy analyte ions. They are generally in the mass range of up to 1,000 u.

If these ions from the matrix substance are used as reference masses, it is then practical to reduce the acceleration voltage of the ions before setting the distance d. If the voltage is reduced by a factor of 16 (for example from 32 kilovolts to 2 kilovolts), the flight time of these ions increases by a factor of 4. In this way distance d can be adjusted more precisely. It is however necessary then to know the target flight time of matrix ions for this low acceleration voltage. This can be measured by a preceding calibration.

For large sample supports with three actuators, it is practical to apply the reference samples for the adjustment of distance exactly over the locations of the actuators. In this way, the distance adjustment of a point is achieved in the first proximity, independent of the distance adjustment of either of the other points. The three distance adjustments for the three actuators can therefore be made independent of one another. If—for higher precision—each distance has to be adjusted in two adjustment cycles, it is practical to perform the fist adjustment cycle for all three points and then the second adjustment cycle.

The considerations discussed here for linear mass spectrometers also apply, as any specialist can appreciate, to time-of-flight mass spectrometers with energy focusing reflectors. Here the reflector voltages must be adjusted proportional to the acceleration voltages.

The method of precise mass determination given here with a time-of-flight spectrometer according to this invention can of course be varied in many ways. The specialist in development of mass spectrometers and their measurement methods can easily realize these variations.

We claim:

1. Method for accurate mass determination of analyte ions in a time-of-flight mass spectrometer using a calibrated mass scale, comprising the steps of (a) placing an analyte substance and a reference substance on a surface of a sample support, (b) introducing the sample support into the time-of-flight mass spectrometer, (c) ionizing the reference substance, accelerating the reference substance ions and measuring the flight time of the reference substance ions, (d) mechanically adjusting a distance d of the sample support from an acceleration electrode nearest to the sample support in response to the measured flight time of the reference substance ions such that, following said adjusting, the flight time of ions of the reference substance is substantially equal to a predetermined calibrated flight time value for that reference substance, (e) ionizing the analyte substance, accelerating the analyte ions and measuring the flight times of the analyte ions, and (f) determining masses of the analyte ions using the calibrated mass scale.

2. Method according to claim 1, wherein electromechanical actuators are used for adjustment of the distance d.

3. Method according to claim 2, wherein the adjusting of distance d is automatically feedback-controlled using said measured flight time of the reference ions.

4. Method according to claim 1, wherein the substances are ionized by a matrix-assisted laser desorption (MALDI).

5. Method according to claim 4, wherein the reference substance ions include at least one of monomeric, dimeric and oligomeric ions of the MALDI matrix substance.

6. Method according to claim 1, wherein acceleration of the analyte ions is delayed relative to the ionizing of the analyte ions.

7. Method according to claim 1, wherein the reference substance ions are relatively light reference substance ions and wherein accelerating of the reference substance ions makes use of relatively small acceleration voltages.

8. Method according to claim 1, wherein introducing a sample support into the mass spectrometer comprises introducing a sample support into the mass spectrometer that is held in a holder frame in a vacuum system of the mass spectrometer, the underside of the holder frame being attached via three actuators to a movement device which can move the sample support within the holder frame parallel to its surface, and wherein placing a reference substance on a surface of the sample support comprises placing samples with reference substance on the sample support to the opposite side of the sample support from the attached actuators, the reference samples allowing for a three-point adjustment of the distance d of the sample support from the nearest acceleration electrode using the actuators.

9. Method according to claim 8, further comprising adjusting the parallelism of the sample support in relation to the nearest acceleration electrode using the actuators.

10. Apparatus for use in determination of analyte molecules in a time-of-flight mass spectrometer, the apparatus comprising (a) a holder frame inside the mass spectrometer that holds a sample support plate, (b) a movement unit that moves the holder frame substantially parallel to the surface of the sample support plate, (c) an acceleration electrode opposing the sample support plate, (d) actuators between the movement unit and the holder frame for adjusting a distance d between the sample support plate and the acceleration electrode, and (e) a reference substance calibration apparatus that ionizes a reference substance on the surface of the sample support, accelerates resulting reference substance ions toward a detector, determines the flight time of the reference substance ions relative to a predetermined calibrated flight time for that reference substance, and controls the actuators in response to the detected flight time to adjust the position of the sample support plate so that future flight times of the reference ions will be substantially equal to the calibrated flight time.

11. Apparatus according to claim 10, wherein the actuators comprise at least one of piezoelements, bimetal elements and motorized actuators.

12. Apparatus according to claim 10, wherein the reference substance calibration apparatus further comprises an electronic or software-operated control system for automatic feedback-adjustment of the distance d of the sample support relative to the acceleration electrode.

13. Apparatus for calibrating a time of flight mass spectrometer, the apparatus comprising:

a sample support having a surface on which an analyte substance and a reference substance are placed, the sample support being locatable within the mass spectrometer;

an adjustment mechanism for adjusting the position of the sample support in a first direction;

an ionizing device for ionizing the reference substance and directing reference substance ions in a direction parallel to the first direction; and a feedback control mechanism that detects the reference substance ions and determines a flight time of the reference substance ions, the feedback control mechanism comparing said determined flight time to a predetermined calibrated flight time for the reference substance and providing a signal to the adjustment mechanism to adjust the sample support such that subsequent ions of the reference substance have a flight time that is substantially equal to the predetermined calibrated flight time.

14. Apparatus according to claim 13 wherein the adjustment mechanism further comprises electromechanical actuators.

15. Apparatus according to claim 13 wherein the reference substance ions are ionized from a MALDI matrix material that is combined with an analyte substance on the sample support.

16. Apparatus according to claim 15 wherein the accelerated reference substance ions include at least one of monomeric, dimeric and oligomeric ions of the MALDI matrix substance.

17. Apparatus according to claim 13 wherein the ionizing device further comprises an accelerator for accelerating the reference ions toward through the mass spectrometer.

18. Apparatus according to claim 17 wherein the reference substance ions are relatively light reference substance ions and wherein the accelerator uses acceleration electrodes that have relatively small acceleration voltages.

* * * * *